United States Patent [19]

Lee

[11] Patent Number: 4,636,760

[45] Date of Patent: Jan. 13, 1987

[54] LOW VOLTAGE CIRCUIT BREAKER WITH REMOTE SWITCHING FUNCTION

[75] Inventor: Anthony Lee, Murrysville Boro, Pa.

[73] Assignee: Westinghouse Electric Corp., Pittsburgh, Pa.

[21] Appl. No.: 721,620

[22] Filed: Apr. 10, 1985

[51] Int. Cl.[4] ..... H01H 75/00; H01H 77/00; H01H 83/00

[52] U.S. Cl. ..... 335/14; 335/6; 335/16; 335/174

[58] Field of Search ..... 335/16, 6, 20, 173, 335/174, 14

[56] References Cited

U.S. PATENT DOCUMENTS

| | | | |
|---|---|---|---|
| 4,001,743 | 1/1977 | Arnhold | 335/201 |
| 4,223,288 | 9/1980 | Stiner | 335/20 |
| 4,532,486 | 7/1985 | Terrier | 333/13 |

*Primary Examiner*—E. A. Goldberg
*Assistant Examiner*—Lincoln D. Donovan
*Attorney, Agent, or Firm*—L. P. Johns

[57] ABSTRACT

A low voltage circuit breaker with remote switching function characterized by an insulating housing containing manually actuator for opening and closing separable contacts and a remotely controlled solenoid for opening the contacts, and the solenoid means being spring biased in the closed contact position only when the manually actuator is in the closed contact position.

7 Claims, 2 Drawing Figures

LOW VOLTAGE CIRCUIT BREAKER WITH REMOTE SWITCHING FUNCTION

CROSS-REFERENCE TO RELATED APPLICATIONS

This application is related to the copending applications Ser. No. 707,616, filed Mar. 3, 1985, entitled "Current Limiting Solenoid Operated Circuit Breaker", of Y. K. Chien, W. V. Bratkowski, and J. W. Wafer; and Ser. No. 707,632, filed Mar. 4, 1985, entitled "Remotely Controlled Solenoid Operating Circuit Breaker", of J. A. Wafer and W. V. Bratkowski, both assigned to the present assignee.

BACKGROUND OF THE INVENTION

1. Field of the Invention

This invention relates to circuit breakers and, more particularly, to circuit breakers having a remotely controlled electromagnetic solenoid and functions both as a current limiting circuit breaker and contactor with a single set of contacts that is operated manually, by a bimetal, or by a short circuit trip coil.

2. Description of the Prior Art

Electrical distribution systems have increased in size and capacity to meet expanding requirements for electrical service. Utilities have adopted lower impedance transformers to reduce system power losses, regulation problems, and costs. Even so, the short circuit fault currents available to plague distribution systems continue to increase, reaching as high as 200,000 A. To prevent these high available fault currents from damaging electrical distribution systems, protective devices limiting the perspective let-through currents are required. Fuses and, more recently, current limiting circuit breakers, have been used successfully to limit these fault currents. They can reduce, to tolerable levels, both the peak fault currents ($I_p$) and thermal energy ($I^2t$) that reach downstream equipment. Mechanical and magnetic forces that can destroy equipment are proportional to the square of the peak currents $(I_p)^2$, and thermal damage is proportional to the energy let-through ($I^2t$).

The use of low impedance transformers and interconnected networks of low voltage AC power distribution systems results in large short circuit currents. Fault currents in excess of 100 KA are common. Traditionally, high fault current prediction has been provided in current limiting fuses in conjunction with circuit breakers. However, a new generation of high speed electromagnetically driven, single, and multiple circuit breaker limiting devices have been developed. These devices not only perform the function of a current breaker and current limiting fuse, but are also resettable and reusable. These devices can also be effectively applied to motor control as well as power distribution systems.

Such distribution systems are increasingly adopting automated distribution means which are powered from the distribution secondary circuits and are designed to control and monitor the status of capacitor banks, protective devices, current switches, and distribution transformers connected to primary circuits of the distribution system.

A disadvantage of some prior circuit breakers has involved the safety of personnel. Some prior circuit breakers could be actuated by remote control to an "on" or closed circuit connection, even through the breaker had been previously tripped to an open circuit by a person on-site for some purpose such as maintenance.

SUMMARY OF THE INVENTION

In accordance with this invention, a circuit breaker for use in energy management systems is provided that comprises an insulating housing having line and load terminals; separable contact means including a stationary contact and a movable contact disposed in the housing to form a circuit breaker path between the terminals; manual actuating means within the housing for operating the circuit breaker and including an operating lever for opening and closing the contacts; arc quenching means adjacent to the circuit breaker path in the housing; the stationary contact including an arc guide rail forming part of the arc quenching means; another guide rail forming another part of the arc quenching means; the movable contact being a lever pivotally mounted on the other guide rail; electromagnetic means including a solenoid and plunger assembly for moving the movable contact to the open position in response to an electric current from a source remote from the circuit breaker; spring biased means for retracting the plunger upon deenergization of the solenoid; and the operating lever being positioned to prevent closing of the contacts upon deenergization when the manual actuating means is in the open-contact position.

The advantage of the device of this invention is that it provides a combination of electrical circuit protection and remote load energy management and is suitable for installation in a user's breaker panel directly substituting for an existing breaker due to the reduction in size of an arc chute having fewer plates which are adequate for 240 V/120 V applications, whereby space is created for solenoid and linkage for the switching function.

DESCRIPTION OF THE PREFERRED EMBODIMENT

Figure 1:
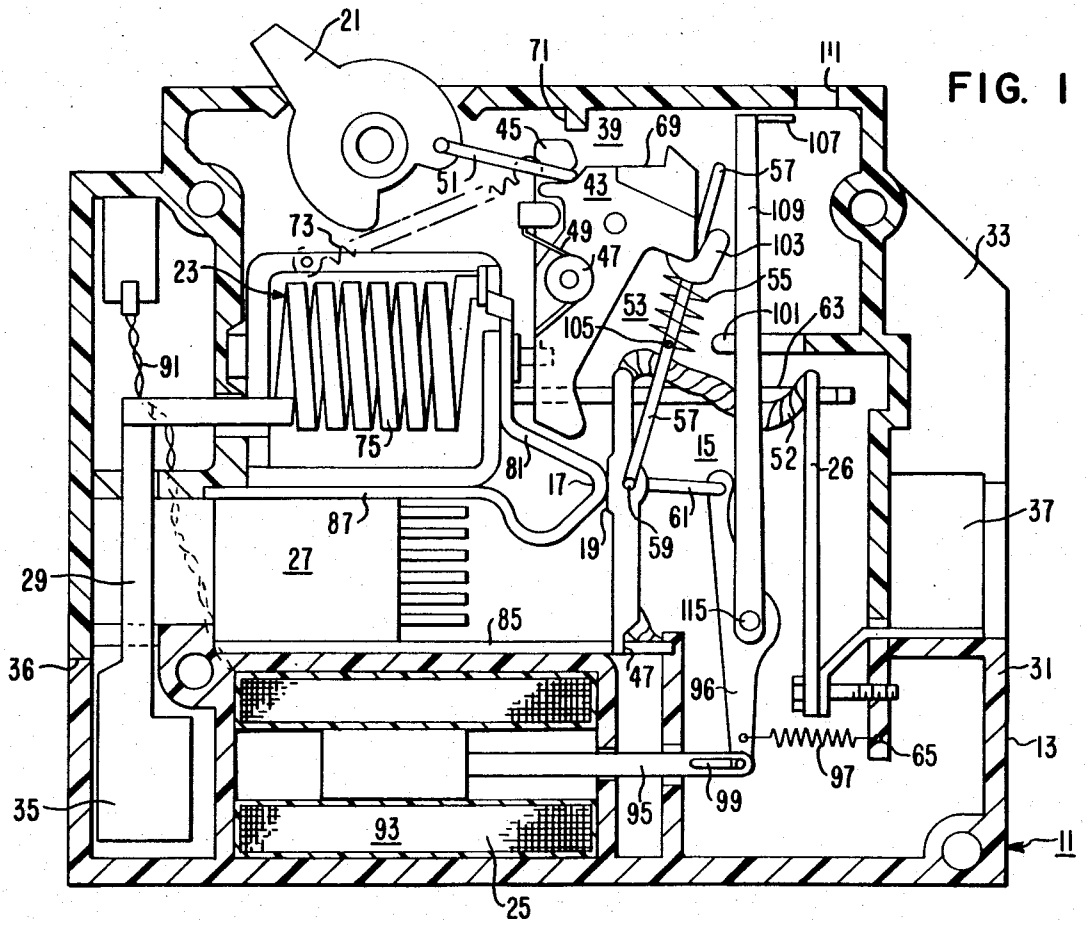
FIG. 1 is a vertical sectional view through a circuit breaker showing the contacts in the closed position.

In the drawings, a circuit breaker is generally indicated at 11 and it comprises a housing 13 and a circuit breaker structure 15 which includes stationary contact 17 and movable contact or contact member 19. The circuit breaker also comprises means for actuating the movable contact including a handle 21, a current limiting electromagnetic mechanism 23, a solenoid structure 25, and a bimetal strip 26. The circuit breaker 11 also comprises an arc quenching device 27 and a conductor 29.

The housing 13 is comprised of a body 31 and a detachable cover (not shown), both of which are comprised of an electrically insulating material, such as an epoxy resin. A line terminal 35 is mounted within an opening 36 of the housing body where it is adapted for engagement with a clip-on connector (not shown). A load terminal 37 is disposed at the right end of the circuit breaker where it is similarly adapted for connection with a clip-on or screw-on connector.

The circuit breaker structure 15 is mounted within the chamber of the housing 13 and comprises an unlatching mechanism 39. Mechanism 39 includes an operating or kicking lever 43 and a releasing lever 45, which are pivotally mounted on a pivot pin 47. The releasing lever 45 fits within a recess of the operating lever 43 where it is retained in place by a bias spring 49. A wire bail 51 extends from the handle 21 to the upper end of the releasing lever 45. Generally, the structure and operation of the unlatching mechanism 39, the operating lever 43, and the releasing lever 45 are set forth in U.S. Pat. No. 4,001,743.

The movable contact 19 is an elongated member pivoted in a hole 47 in an arc guide rail 49. The upper end of the contact 19 is connected to a shunt 52 which is connected to the upper end of the bimetal strip 26. The movable contact 19 is influenced by a spring assembly 53 which includes a coil spring 55 and a spring guide bail 57. The lower end of the bail 57 is pivotally connected at 59 where a link 61 is similarly pivoted. In operation, the spring assembly 53 functions as a toggle spring mechanism for moving the contact 19 between the closed position (FIG. 1) and the open position (FIG. 2), whereby the pivot 59 moves from one side of a line extending from the hole 47 and the upper end of the spring 55.

The contacts 17, 19 are opened and closed by conventional means including the manually operated handle 21 and the bimetal strip 26. The bimetal strip is operable through a link 63 which extends from the strip to the release lever 45, whereby an overcurrent passing through the bimetal strip causes it to move clockwise about its lower end where it is connected to a conductor 65, thereby moving the link 63 to the right to actuate the release lever 45.

Figure 2:
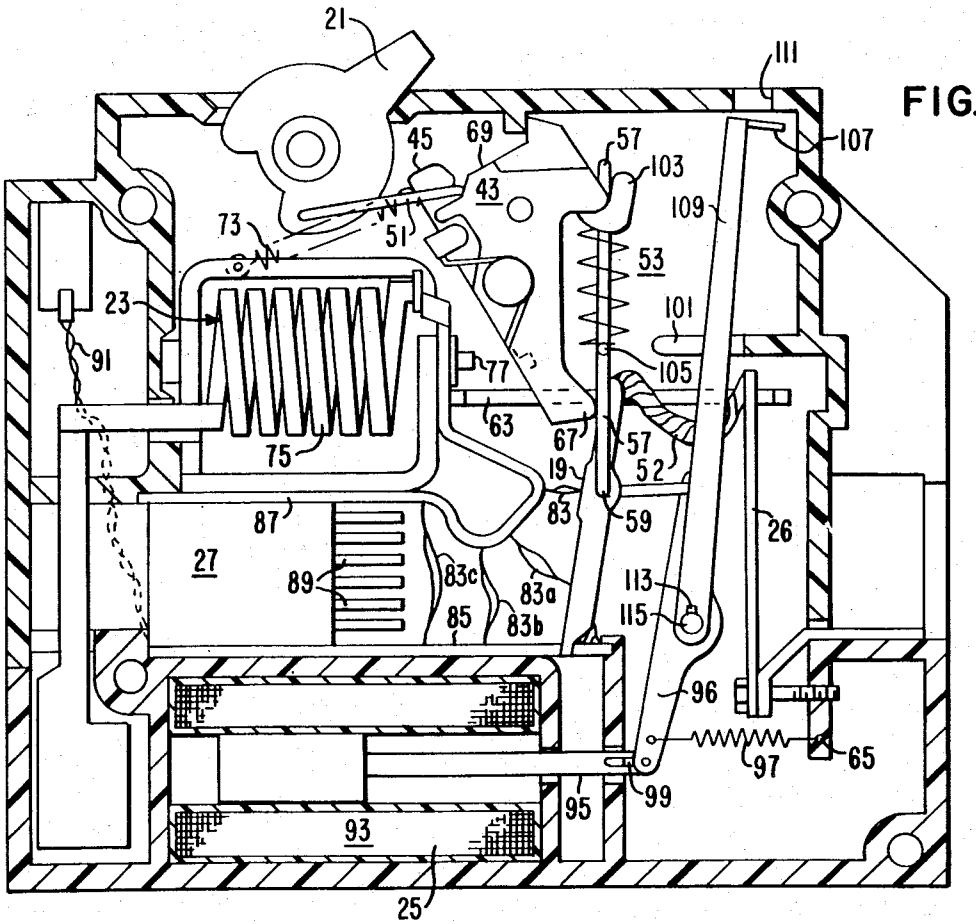
FIG. 2 is a vertical sectional view showing the contacts in the open position.

Rotation of the release lever 45 rotates the kicking lever 43 counterclockwise, whereby the lower end 67 of the lever 43 kicks the movable contact 19 away from the stationary contact 17 (FIG. 2). Simultaneously, the release lever 45 rotates to a retracted position to unlatch the bail 57 from a latched position (FIG. 1) between the levers 43 and 45. As the movable contact 19 moves, the spring assembly 53 moves overcenter to release the coil spring 55 that, in turn, rotates the lever 43 counterclockwise to retain the movable contact in open position (FIG. 2).

Simultaneously, the unlatched bail 57 rides over a surface 69 of the lever 43 until the lever hits a stop 71 protruding from the housing. A spring 73 rotates the handle 21 to the "off" position after the contacts are open and resets the wire bail 57 in a notch (FIG. 2) between the levers. In this manner, the lever 43 moves quickly to open the contacts without being delayed by overcoming inertia of rotating the handle 21 from the "on" to "off" position; however, it is understood that the overall action is so fast that it appears to be simultaneous.

The current limiting electromagnetic device 23 comprises a coil 75 and an armature 77 supported within a frame 79 that is mounted on the housing body 13. If a release operation is a result of a short circuit, the armature 77 strikes the release lever 45 to actuate the kicking lever 43, thereby moving the spring assembly 53 through the toggle operation to move the movable contact 19 to the position shown in FIG. 2.

The circuit through the breaker 11 (FIG. 1) extends from the line terminal 35 through the conductor 29, coil 75 and a conductor 81 including the stationary contact 17, the movable contact 19, the shunt 52, the bimetal strip 26, and the conductor 65 to the load terminal 37.

During separation of the contacts 17, 19, any arc 83 occurring between the separate contacts (FIG. 2) travels from the point of origin into the arc quenching device 27 such as indicated by arc positions **83*a*, 83*b*, and 83*c* with the arc extending to a greater length between the lower portions of the conductor 81 and the lower portions of the contact member 19. From there, a lower arc guide rail 85 and an upper guide rail 87, with which the conductor 81 is an integral part, guide the arc to extinguishing plates 89 where the arc is extinguished. It is noted that the number of arc extinguishing plates 89 is limited to about six which reduces the size of the arc chute and should be adequate for low voltage (240/120 V) applications. In this manner, space is created for the solenoid 25** for actuation of the switching function which is adequate for residential or light commercial industrial circuits for replacing existing circuit breakers in conventional control panels.

In accordance with this invention, the solenoid structure 25 comprises a coil 93, a plunger 95, and a lever 96. The solenoid plunger 95 is spring biased, such as by a coil spring 97, in the closed contact position (FIG. 1). To hold the contacts open, the solenoid is energized with the plunger retracted (FIG. 2). Thus, the contacts are retained open so long as the plunger 95 is retracted. However, when the plunger is extended (FIG. 1), the contacts may be opened or closed either manually by the handle 21, or in response to a short circuit passing through the bimetal strip 26. For that purpose a slot 99 is provided in the outer end of the plunger 95, whereby the contacts 17, 19 may be opened or closed when the solenoid is inactivated and biased outwardly by the spring 97.

To enable the spring assembly 53 to move back and forth over toggle during opening and closing of the contacts 17, 19, a projection 101 of the housing is in contact with the spring assembly to cooperate with the operating lever 43. Thus, when the contacts are closed, the spring portion of the assembly 53 is contracted (FIG. 1) and expanded when the contacts are open (FIG. 2). The bail 57 is thereby free to move slightly within the spring during the overcenter toggle operation with the spring expanding and contracting between a portion 103 of the lever 43 and an out-turned shoulder 105 of the bail 57. Finally, a flag 107 mounted on a link 109 is movable between a hole 111 in the cover 33 to indicate that the contacts are open (FIG. 2) or that contacts are closed (FIG. 1). For that purpose, the lower end of the link 109 is keyed at 113 on a pivot pin 115 of the lever 96 extending between the plunger slot 99 and the link 61 for moving the contact 19 between open and closed positions.

In conclusion, the circuit breaker of this invention provides a current limiting solenoid operated means for an energy management system by an electric current, which is applied only for opening and maintaining the contacts open. The circuit breaker cannot be actuated to a closed circuit condition by remote control when a manual handle is in the trip or "off" position. The circuit breaker cannot be actuated to a closed circuit condition by a manual handle when the remote control power is maintained keeping the contacts open. In an event of control power failure, the breaker will retain all the functional characteristics of a breaker with its status dictated by the manual position or trip status.

What is claimed is:

1. A circuit breaker for use in remote load energy management systems, comprising:

an insulating housing having line and load terminals;

separable contact means including a stationary contact and a movable contact member disposed in the housing to form a circuit breaker path between the terminals;

manual actuating means within the housing for operating the circuit breaker and including an operating lever for opening and closing the contacts;

electromagnetic means including a plunger for opening the movable contact and energizable by an electric current from a source remote from the circuit breaker;

the electromagnetic means including connector means between the electromagnetic means and the movable contact;

the electromagnetic means including recoil means for retracting the plunger upon deenergization of the electromagnetic means;

the operating lever being positioned to prevent closing of the contacts upon deenergization when the manual actuating means is in an open-contact position;

the movable contact comprising a first lever pivotally mounted for movement between open and closed positions of the stationary contact; and the connector means including a second lever connected between the plunger and the first lever.

2. The circuit breaker of claim 1 in which the connector means includes a link between the levers.

3. The circuit breaker of claim 1 in which arc chute means are disposed adjacent to the circuit breaker path within the housing.

4. A circuit breaker for use in energy management systems, comprising:

(a) an insulating housing having line and load terminals;

(b) separable contact means including a stationary contact and a movable contact disposed in the housing to form a circuit breaker path between the terminals;

(c) manual actuating means within the housing for operating the circuit breaker and including an operating lever for opening and closing the contacts;

(d) arc quenching means adjacent to the circuit breaker path in the housing;

(e) the stationary contact including an arc guide rail forming part of the arc quenching means;

(f) another guide rail forming another part of the arc quenching means;

(g) the movable contact being movably connected to the other guide rail;

(h) electromagnetic means including a plunger for moving the movable contact to the open position in response to an electric pulse from a source remote from the circuit breaker;

(i) means for retracting the plunger upon deenergization of the electromagnetic means; and (j) the operating lever being positioned to prevent closing of the contacts upon deenergization when the manual actuating means is in the open-contact position.

5. The circuit breaker of claim 3 in which the movable contact is a lever pivotally mounted on the other guide rail.

6. The circuit breaker of claim 5 in which the manual operating means includes an overcenter toggle joint.

7. The circuit breaker of claim 6 in which the electromagnetic means comprises a solenoid including the plunger and the plunger being spring biased in the closed contact position.

* * * * *